United States Patent [19]

Tamaru et al.

[11] Patent Number: 4,550,324

[45] Date of Patent: Oct. 29, 1985

[54] INK TRANSFER THERMAL PRINTER

[75] Inventors: Munetaka Tamaru; Naomichi Suzuki, both of Tokorozawa, Japan

[73] Assignee: Citizen Watch Company Limited, Tokyo, Japan

[21] Appl. No.: 514,225

[22] Filed: Jul. 15, 1983

[30] Foreign Application Priority Data

| | | | |
|---|---|---|---|
| Jul. 16, 1982 | [JP] | Japan | 57-123930 |
| Aug. 10, 1982 | [JP] | Japan | 57-138964 |
| Sep. 21, 1982 | [JP] | Japan | 57-163230 |
| Feb. 24, 1983 | [JP] | Japan | 58-28524 |
| Mar. 4, 1983 | [JP] | Japan | 58-34345 |
| Jun. 14, 1983 | [JP] | Japan | 58-104947 |

[51] Int. Cl.[4] ..... B41J 3/20

[52] U.S. Cl. ..... 346/76 PH; 346/140 R; 250/318

[58] Field of Search ..... 346/140 R, 140 A, 76 R, 346/76 PH, 105; 400/120; 214/216; 250/317.1, 318

[56] References Cited

U.S. PATENT DOCUMENTS 4,140,907 2/1979 Oba ..... 346/76 R 4,297,714 10/1981 Ando et al. ..... 346/76 PH

*Primary Examiner*—E. A. Goldberg

*Assistant Examiner*—A. Evans

*Attorney, Agent, or Firm*—Jordan and Hamburg

[57] ABSTRACT

An ink transfer type of dot printer utilizes thermo-sensitive ink which is solid at normal temperatures, with selected portions of the ink being liquified by heating and transferred onto recording paper. Such a printer can be of contact or of non-contact (e.g. ink-jet) configuration, and eliminates the need to utilize disposable materials such as ink ribbons etc.

20 Claims, 18 Drawing Figures

INK TRANSFER THERMAL PRINTER

BACKGROUND OF THE INVENTION

The present invention relates to an ink transfer thermal printer for forming characters, graphics, etc. as patterns of dots upon a recording medium such as recording paper, and is characterized by the use of a thermo-sensitive ink which is solid at normal ambient operating temperatures and is transferred to a recording paper by melting selected portions of the ink by localized heating.

High speed printers used in data processing applications can be basically classified into impact and non-impact printers. The highest speeds are attainable with non-impact printers, which also have the advantage of a low level of operating noise. The main types of non-impact printers in use at present are thermal printers, in which dot patterns representing characters etc. are formed by selective heating of minute areas of a thermo-sensitive recording paper, or of an ink ribbon or ink film having thermo-sensitive ink coated thereon, with portions of the thermo-sensitive ink being melted and transferred by contact to the recording paper, and ink jet printers. In the case of ink jet printers, ink stored in liquid form is selectively ejected through extremely small apertures onto a recording paper, to thereby form patterns of dots. Such a method enables a high speed of printing, since the printing head and the recording paper can be kept out of contact with one another. However since the ink is a liquid at normal temperatures, problems arise due to evaporation of the ink. Such evaporation makes storage of the ink difficult over a long time period, and in addition results in material being deposited in the ink ejection apertures which come to block these apertures. Thus, such prior art ink jet printers are basically unsatisfactory with regard to reliability and the need for frequent maintenance, and the difficulty of storing the ink.

In the case of a thermal printer which utilizes an ink ribbons or ink films, the problem arises that large amounts of consumable materials must be stored before use and disposed of after use, i.e. the used ribbons or films. Apart from the substantial cost of such materials, the necessary storage space for these is a hindrance to making such a printer compact and lightweight, and replacement of the ink ribbons or ink films is generally troublesome and timeconsuming.

One approach which has been suggested to overcome these problems of thermal printers which use ink ribbons or ink films is to utilize an endless fabric tape, upon which portions of thermo-sensitive ink are selectively deposited at a position distant from the recording paper, and then are transferred from the tape to the recording paper by rollers. However such a scheme is very complex mechanically, and so is unsatisfactory from the aspect of manufacturing cost, as well as with regard to size and weight.

It is an objective of the present invention to eliminate these disadvantages of prior art types of ink transfer thermal printer, by providing a printer which employs thermo-sensitive ink that is solid at normal temperatures, and which is utilized directly (i.e. without being formed upon some other medium such as plastic ribbon or film). Since the thermo-sensitive ink is completely consumed during the printing process, there is no need for disposal of waste materials, so that maintenance is greatly simplified, and the printer can be made compact and lightweight. In addition, since the thermo-sensitive ink is solid at normal temperatures, it can be inserted into the printer very easily, without danger of the operator's hands being soiled. Furthermore, the present invention can be adapted to provide an ink jet type of operation, in which thermo-sensitive ink that has been selectively liquified by heating is ejected through small apertures to form dots on the recording paper. In this case, since the thermo-sensitive ink is maintained in the solid state until immediately before it is consumed in the printing process, formation of undesirable materials by evaporation of the ink does not occur, so that such a ink transfer thermal printer provides much more reliable operation than has been possible with prior art types of ink jet printer using liquid ink.

SUMMARY OF THE DISCLOSURE

An ink transfer thermal printer according to the present invention basically comprises a thermo-sensitive ink which is solid at normal ambient temperatures and can comprise a wax or resin containing a mixture of pigments and dyes, recording paper, printing means for selectively heating portions of the ink and transferring at least a part of the heated portions onto the recording paper to harden and form dots thereon, and means for moving the recording paper relative to the latter printing means (i.e. a paper advancement mechanism).

As will be made clear from the preferred embodiments, various forms of ink transfer thermal printer according to the present invention can be envisaged. The thermo-sensitive ink can be formed into very narrow rods, which are held in contact with the recording paper, and with means being provided for selectively heating small regions of the recording paper such that heat is transferred from the recording paper to the tips of corresponding thermo-sensitive ink rods to thereby melt the tips and so form dots on the recording paper. In this case, since the size of the dots that are printed is essentially determined by the cross-sectional area of the thermo-sensitive ink rods, the means for heating the selected areas of the recording paper can be simple and easily manufactured since they need not be of very minute size.

Alternatively, heater elements arranged around small apertures disposed immediately above the recording paper and in contact with the thermo-sensitive ink can be selectively activated to melt adjacent portions of the thermo-sensitive ink, with the ink thereby flowing through the corresponding apertures onto the recording paper. With another form of such a printer, heater means can be provided for guiding and transporting the thermo-sensitive ink towards the heater elements and apertures, by melting and capillary action.

It is also possible to dispose the thermo-sensitive ink and heater elements within a hermetically sealed chamber which is maintained at a pressure higher than atmospheric pressure, to thereby forcibly eject drops of ink onto the recording paper from the apertures of selectively activated heater elements, i.e. to provide a type ink jet printing. The operation of such a printer can be improved by arranging that the air pressure within the hermetically sealed chamber rises above the atmospheric pressure in a periodic manner, in synchronism with electrical signals applied to drive the heater elements.

Such a pressurized chamber can also be utilized with means for guiding and supplying the thermo-sensitive ink to ink ejection apertures in the chamber being formed on an external face of the chamber.

These various forms of an ink transfer thermal printer according to the present invention will be made more clear from the following description of the preferred embodiments. It will be understood from these that such a printer can be made extremely simple in mechanical configuration, and has significant advantages over prior art types of thermal printer and ink jet printer with regard to ease of maintenance, reliability, and compactness.

DESCRIPTION OF THE PREFERRED EMBODIMENTS

Figure 1:
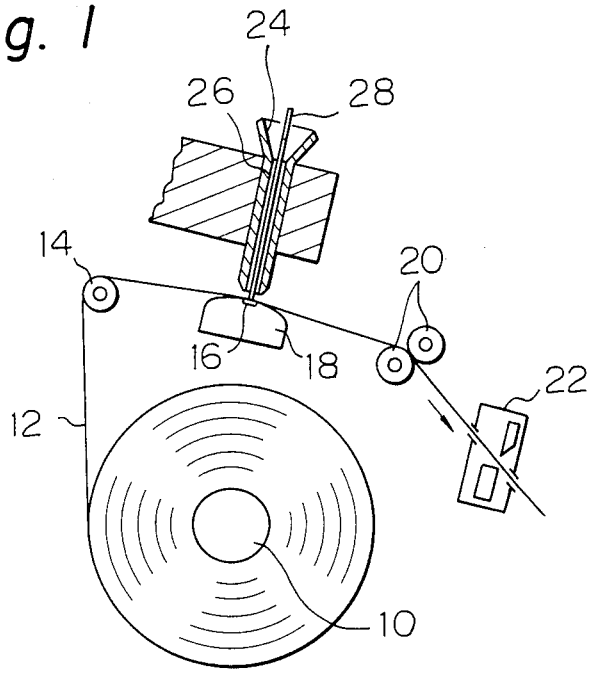
FIG. 1 and FIG. 2 illustrate a first embodiment of the present invention, in which narrow rods formed of thermo-sensitive ink are held in contact against the recording paper, with the opposite side of the paper being selectively heated.

FIG. 1 is an outline diagram in side view and partial cross-section, to illustrate the overall configuration of a first embodiment of the present invention. Numeral 12 denotes recording paper, which can comprise ordinary paper stock, and is wound on a supply reel 10. The recording paper passes over a guide roller 14, then over a transfer head 18 into which are built heater elements 16. These heater elements 16 can generate heat very rapidly, in response to electrical signals. The recording paper is then drawn through paper advancement rollers 20, to be output and sliced by a cutter 22. Hard thermo-sensitive ink rods 28 are held in contact against recording paper 12 at positions immediately opposite corresponding ones of heater elements 16, i.e. recording paper 12 is held pressed between the thermo-sensitive ink rods 28 and heater elements 16 at these positions. The thermo-sensitive ink rods 28 are passed through corresponding guide pipes 24. These thermo-sensitive ink rods 28 can be formed of a wax or resin containing a mixture of pigments and dyes which is solid at normal ambient temperatures, and each has a diameter of the order of 0.10 mm, and can be of circular, triangular, square, hexagonal, octagonal or other suitable shape in cross-section. A bore 26 is provided in guide pipe 24, which is highly machined such that thermo-sensitive ink rod 28 can fit closely therein but can move freely through the bore. The guide pipes 24 are disposed with the ends thereof set at a suitable spacing from recording paper 12, such as to ensure that thermo-sensitive ink rod 28 will not be broken. Tension is imparted to recording paper 12 by guide roller 14 and paper advancement rollers 20, to thereby bring recording paper 12 stretched into close contact with transfer head 18. If the load imparted by supply reel 10 is not sufficient to impart the necessary degree of tension in recording paper 12, then additional guide rollers can be provided to transport recording paper 12, and a spring (not shown in the drawings) set into contact with the shaft of supply reel 10 to provide increased friction. Additionally, other measures can be adopted if necessary to provide sufficient tension in recording paper 12, such as providing a clutch mechanism coupled to the shaft of supply reel 10 which enables adjustment of the degree of braking applied to the shaft by momentarily rotating the shaft in the reverse direction.

Figure 2:
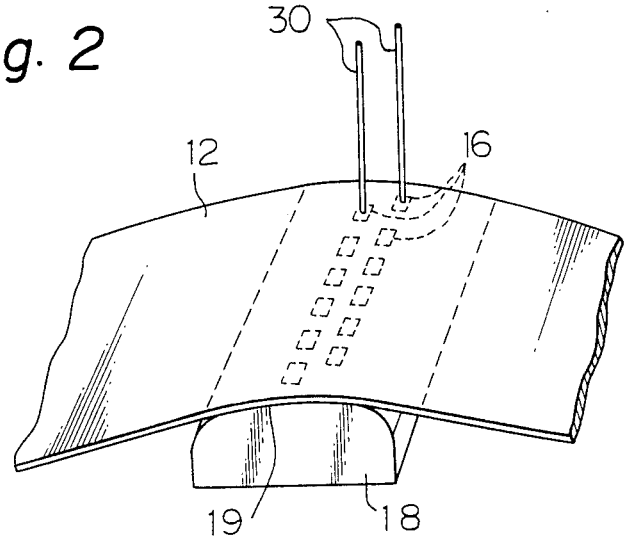

FIG. 2 is an expanded oblique view of the transfer head. A curved surface 19 is provided on transfer head 18, to provide good sliding contact with recording paper 12. Two rows of rectangular heater elements 16 are arrayed on transfer head 18, each heater element being approximately 0.12 mm square, with the heater elements being spaced approximately 0.08 mm apart. The thermo-sensitive ink rods 28, each having a diameter of the order of 0.01 mm, are positioned with the tips thereof in contact with recording paper 12 at points immediately opposite corresponding ones of heater elements 16. Although in this embodiment the thermo-sensitive ink rods 28 have a cylindrical shape, they can also be given other shapes, as stated above.

In order to implement multi-color printing, the number of rows of heater elements 16 can be increased, with each of such rows being provided with thermo-sensitive ink rods 28 having a different color.

Figure 3:
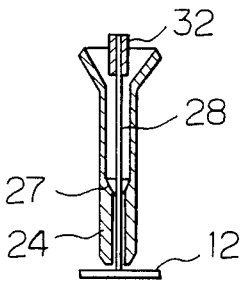
FIG. 3 and FIG. 4 illustrate means whereby the thermo-sensitive ink rods in the embodiment of FIG. 1 can be held in contact against the recording paper.

FIG. 3 is a diagram illustrating an example of means for providing pressure contact between the thermo-sensitive ink rods and the recording paper. The tip of each thermo-sensitive ink rod 28 is fixed in a tube 32, which has a predetermined weight. As the rod becomes used up and hence shorter, as printing operations are performed, tube 32 gradually descends through the bore in guide pipe 24, and finally comes to rest against the stop face 27.

Figure 4:
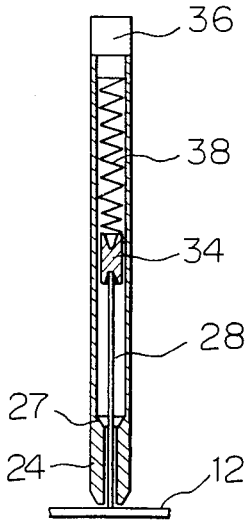

FIG. 4 shows another example of means for applying contact pressure between the thermo-sensitive ink rods and the recording paper. In this case, a pin 34 has a concave portion which engages one end of a thermo-sensitive ink rod 28, with a spring 38 being compressed between a plug 36 (fixedly held in guide pipe 24 by being pressed into the bore thereof) and pin 34, whereby a force is exerted by the spring to force thermo-sensitive ink rod 28 into contact with recording paper 12. As the thermo-sensitive ink rod 28 becomes used up, pin 34 gradually approaches and is finally stopped by the stop face 27.

The operation of this embodiment will now be described. The paper advancement rollers 20 serve to pull recording paper 12 from supply reel 10 into a state of contact against transfer head 18, and to advance recording paper 12 in a continuous or periodic manner while printing is in progress. The heater elements 16 in transfer head 18 are selectively supplied with pulses of electric current to produce heat, in accordance with the characters or graphics which are to be printed. The part of recording paper 12 which is positioned immediately above a heater element 16 that is thus activated will become heated thereby, and as a result the end face of the thermo-sensitive ink rod 28 whch is in contact with that part of recording paper 12 will be heated by heat transferred from the paper, and thereby melted. The melted portion of that thermo-sensitive ink rod 28 is thus transferred to recording paper 12. WHen the flow of current is terminated, then both the top of thermo-sensitive ink rod 28 and the ink that has been transferred onto recording paper 12 will become cooled and so will harden to form a printed dot. By suitably setting the time duration for which current flows in a selected heater element 16, the size of a printed dot can be made substantially equal to the cross-sectional area of one of thermo-sensitive ink rods 28, with the dot size being virtually unaffected by the size of heater element 16. Thus, since the area of heater element 16 can be made slightly larger than the size of a printed dot, the accuracy required for positioning of the thermo-sensitive ink rods 28 is made less stringent.

Some degree of variation in the thickness of recording paper 12 is permissible, with the printer described above. However if the paper used is very thick or very thin, then means can be provided for sensing the temperature attained by the surface of recording paper 12 on the opposite side of the paper from an activated heater element 16, i.e. the temperature of a portion of paper which is heated and contacts a thermo-sensitive ink rod 28. This is equivalent to sensing the thermal conductance of the paper, and enables the time duration for which current is passed through heater element 16 to be controlled in accordance with that value of thermal conductance. Such sensing of the thermal conductance of the paper can be performed by using one of heater elements 16 exclusively for heat sensing, with a sensor being installed in place of guide pipe 24 for that heater element.

Thus, as described hereinabove, the present invention enables a printer to be provided which does not require the use of an ink ribbon or fabric recoating means, and whose mechanism can be made simple and compact. In addition, since the size of the printed dots (i.e. the size of the minimum print element) is determined by the cross-sectional area of the thermo-sensitive ink rods, manufacture of the heater elements is greatly simplified, and finely detailed printing becomes possible. Due to the use of hard ink rods, the dot shape can be freely changed, and maintenance is made simpler and cleaner for the operator. Such a printer can be easily modified to provide multi-color printing, by using only a few more components.

Figure 5:
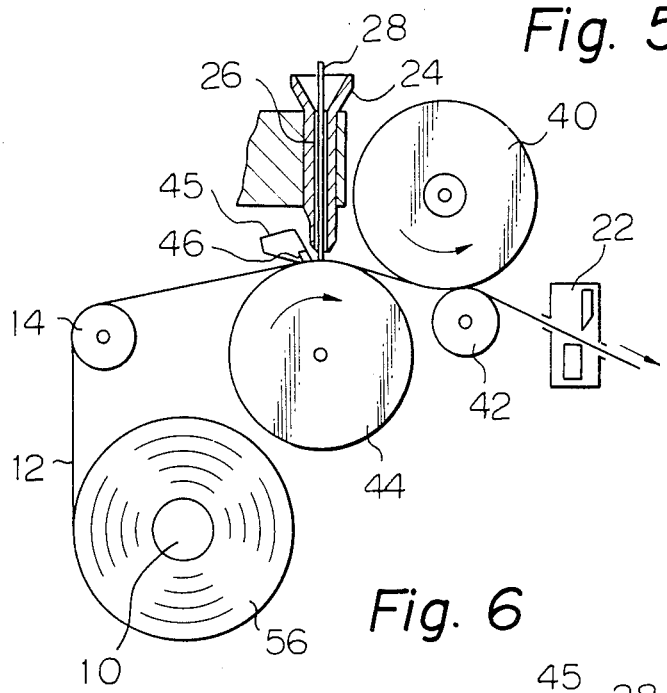
FIG. 5 and FIG. 6 shows a second embodiment of the present invention, in which regions of the recording paper are selectively heated at points slightly in advance of a set of thermo-sensitive ink rods, with respect to the direction of advancement of the recording paper.

FIG. 5 is a diagram to illustrate the overall configuration of this embodiment. The recording paper 12, which can be ordinary paper), is wound around a supply reel 56, and is advanced and held in a state of tension against the surface of a platen 44 by a guide roller 14 and a platen roller 44, pinch roller 40 and a drive roller 42. Each of these rollers extends over the entire width of the recording paper 12. The output recording paper is cut by a cutter 22.

Figure 6:
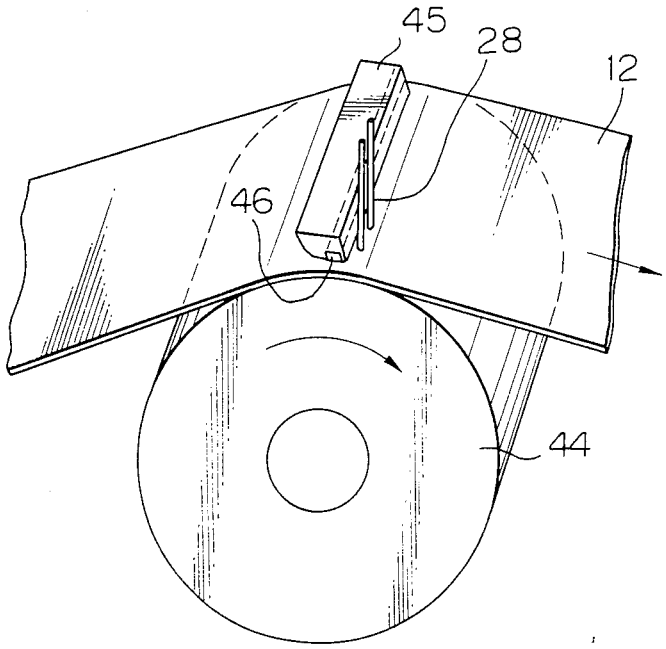

Solid thermo-sensitive ink 28 formed into a thin rod is lead through a bore 26 formed in each of a plurality of a guide pipes 24 to be held in contact against the upper surface of recording paper 12 on platen roller 44, with a suitable degree of pressure between the ink and paper. A thermal head 45 is set in contact with recording paper 12 at a position which is slightly in advance of the positions at which the tips of thermo-sensitive ink rods 28 contact recording paper 12 (i.e. advanced with respect to the direction of advancement of recording paper 12). As shown in FIG. 6, a row of thermo-sensitive ink rods 28 is each provided with a corresponding one of a row of heater elements 46 in thermal head 45. These heater elements 46 are selectively heated by passing electrical currents therethrough. The heat thus supplied mainly acts to heat recording paper 12, however part of the heat acts upon thermo-sensitive ink 28. In FIG. 6, it can be seen that recording paper 12 is passed over platen roller 44, and a plurality of mutually adjacent rods of thermo-sensitive ink 28, arrayed in line, are positioned behind thermal head 45 (with respect to the direction of advancement of recording paper 12). As state for the first embodiment, color printing can be implemented by providing a plurality of sets of thermal heads combined with corresponding sets of colored thermo-sensitive ink rods.

The operation of this embodiment will now be described. The recording paper 12 is pulled forward from the supply reel 56 by pinch roller 40 and drive roller 42, and is transferred onto platen roller 44 while being held in close contact with that roller. Selected ones of the heater elements 46 are activated for fixed time intervals by having an electric current passed through them, to thereby heat portions of recording paper 12 each of which has almost the same area as the tip of a thermo-sensitive ink rod 28. Such a heated portion of recording paper 12 immediately thereafter moves into a position where it is contacted by a thermo-sensitive ink rod 28, whereby the ink is melted and thereby transferred to recording paper 12. The platen roller 40 is preferably formed of a material which has a low thermal conductivity.

Figure 7:
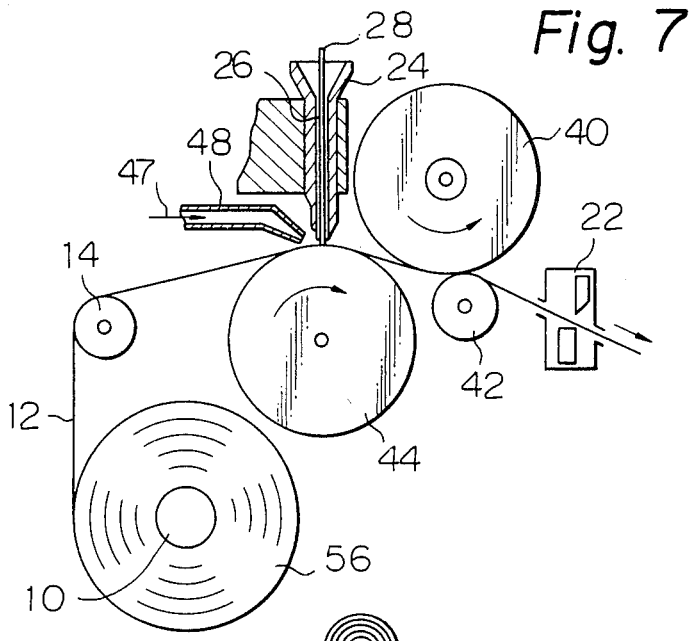
FIG. 7 illustrates an embodiment similar to that of FIG. 5 and FIG. 6, but in which air jets are used to selectively heat areas of the recording paper.

FIG. 7 is a diagram showing the general configuration of a second embodiment of the present invention. The configuration is almost identical to that of the first embodiment, however instead of using heater elements in the thermal head, a plurality of heater nozzles 48 are arrayed in line, through which jets of hot air 47 can be selectively passed. When this hot air 47 is ejected from a selected one of heater nozzles 48 during a fixed time interval, a corresponding portion of the upper surface of recording paper 12 is heated, while at the same time a blast of hot air carries out preheating of a side face of the corresponding thermo-sensitive ink rod 28. This preheating is not sufficient to raise the thermo-sensitive ink to the melting point, but this heating in conjunction with the temperature of the heated portion of recording paper 12 (when this arrives at the thermo-sensitive ink rod 28) act in combination to melt the ink and thereby transfer the ink to the recording paper.

Figure 8:
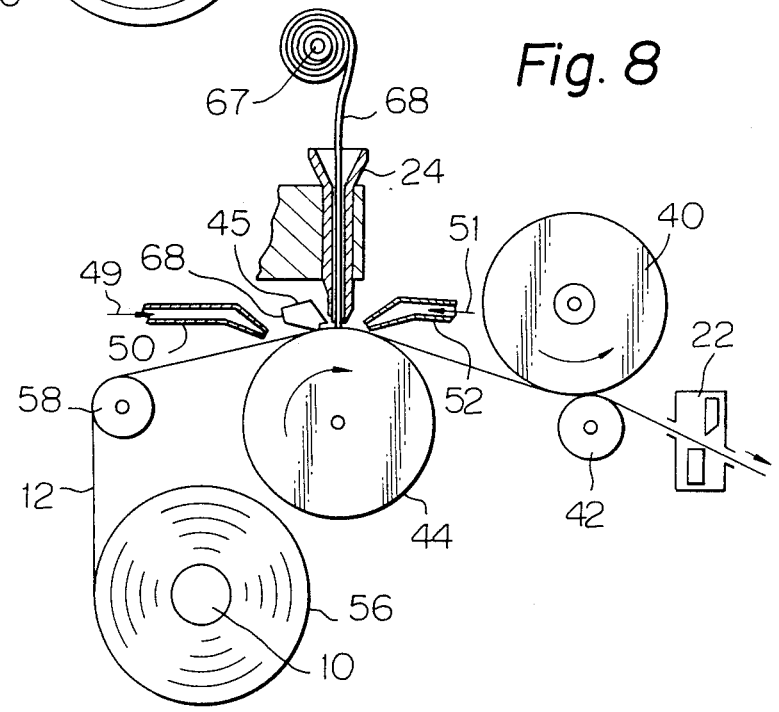
FIG. 8 shows another embodiment of the present invention, similar to that of FIG. 5, but in which an elongated spiral coil of thermo-sensitive ink in the shape of wire is utilized.

FIG. 8 is a side view taken in partial cross-section to illustrate the general configuration of a third embodiment of the present invention. This is basically similar to the embodiment of FIG. 5, and therefore only points which differ from that embodiment will be described. The thermo-sensitive ink 68 is formed into the shape of an elongated wire, which is wound into a spiral similar to that in which resin-core solder is commonly formed. This coil is wound on an ink reel 31, with the thermo-sensitive ink being continuously or intermittently (i.e. in synchronism with heater elements being activated) advanced by rotation of ink reel 31 at a suitable speed. The thermal head 45 is identical to that of the first embodiment, however a set of preheater nozzles 50 is provided, each corresponding to one of the ink spirals 67 and being positioned slightly in advance of thermal head 45 (with respect to the direction of advancement of the paper) to preheat the ink by a jet of hot air 31. In addition, a set of cooling nozzles 52 is provided, each corresponding to one of the ink spirals 67 and posiioned slightly behind the thermo-sensitive ink 68 (with respect to the direction of advancement of the paper) to perform cooling by a jet of cool air 51, to thereby immediately harden and so stabilize each printed dot immediatelya after it is transferred onto recording paper 12. The preheating nozzles 50 and cooling nozzles 52 do not contact recording paper 12.

It is preferable that the area of the tip of thermo-sensitive ink 28 or 68 which contacts recording paper 12 is made substantially identical in shape to the dots which are to be printed, i.e. to the smallest printing units. It is possible to make other parts of the thermo-sensitive ink 28 or 68 larger in width than the tip portion which contacts recording paper 12, and to perform intermediate melting and solidification of the ink to produce the desired final tip shape.

In addition to utilizing electrical power or hot air jets, it is also possible to use light to supply heat by the thermal head. Preheating and cooling means, as well as circuit means for performing temperature compensation of ink heating in response to changes in paper thickness or ambient temperature can also be employed if necessary. The advancement force applied to recording paper 12 need not be produced by motor drive of pinch roller 40 or drive roller 42 alone, but if necessary can also be applied through supply reel shaft 10, guide roller 14, etc. It is also possible to envisage combining the thermo-sensitive ink rods 28 or spiral coils 68 with guide pipes 24 into the form of a cassette.

Figure 9:
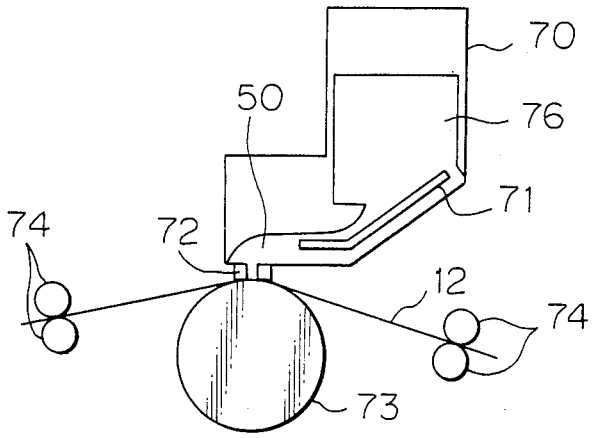
FIG. 9 and FIG. 10 shows another embodiment of the present invention, in which thermo-sensitive ink that is selectively liquified by heater elements flows through apertures onto the recording paper.

FIG. 9 is an outline drawing showing the general configuration of another embodiment of the present invention. A thermo-sensitive ink receptacle 70 contains a thermo-sensitive ink melting heater 71. A plurality of heater elements 72 are positioned at the outer end of thermo-sensitive ink receptacle 70. A recording medium 12, comprising for example recording paper, is placed in contact with the heater elements 72 by a platen 73. The recording medium 12 is transported by advancement rollers 74.

A thermo-sensitive ink block 76 is contained in thermo-sensitive ink receptacle 70. The lower part of this block is in a liquid state due to melting, while a cooling space 50 is provided between the heater elements 72 and thermo-sensitive ink melting heater 71. The thermo-sensitive ink which has been melted by thermo-sensitive ink melting heater 71 is allowed to radiate heat in cooling space 50, to thereby reduce the degree of liquifaction thereof by cooling.

Figure 10:
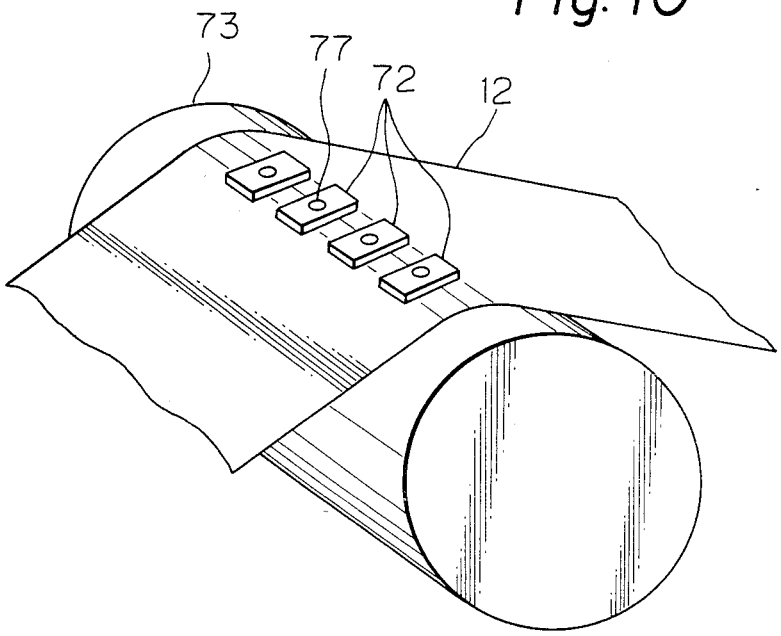

FIG. 10 is an expanded oblique view of the heater element area. Each of the heater elements 72 is provided with a central ink flow aperture 77, to allow the melted ink to flow through. The reduction of the degree of liquifaction of the thermo-sensitive ink is such that the ink can flow to reach the heater elements 72, yet is not sufficient to permit the ink to pass through the ink flow apertures 77 in heater elements 72.

A thermo-sensitive ink block 76 is inserted from the top downwards into thermo-sensitive ink receptacle 70. This thermo-sensitive ink block 76 can comprise for example a wax formed of dyes and pigments, etc, which is solid at normal temperatures and becomes liquid at a temperature of the order of 100° C. The color of the ink can be selected as desired. The thermo-sensitive ink block can be rectangular in shape, or cylindrical, flattened, or formed in any other suitable shape, in accordance with the internal shape of the thermo-sensitive ink receptacle 70.

The lower end of the thermo-sensitive ink block 76 comes into contact with a thermo-sensitive ink melting heater 71. When thermo-sensitive ink block 76 is inserted, current is passed through an electrode of thermo-sensitive ink melting heater 71, whereby the lower part of thermo-sensitive ink block 76 is melted and liquified, allowing the thermo-sensitive ink to flow down onto the heater elements 72. By the time this occurs, the ink has lost some degree of liquifaction, due to heat radiation, and so cannot pass through the ink flow apertures 77 in heater elements 72 shown in FIG. 10.

If a pulse of current is now passed through an electrode (not shown in the drawings) of one of heater elements 72, then thermo-sensitive ink 72 which is in contact with that activated heater element 72 will be liquified to a sufficient degree to allow passage of the ink through the corresponding ink flow aperture 77, and a drop of the ink is thereby transferred to recording medium 12. Subsequently, the transferred ink is cooled by radiation, and so adheres to the recording medium. A pulse of current is passed through the thermo-sensitive ink melting heater 71 in synchronism with the pulse of current that is passed through the heater element 72 electrode, whereby the thermo-sensitive ink is further melted and liquified to be thereby transferred to heater elements 72.

The recording medium 12 is held in contact with the heater element 72 by a platen 73, and is advanced by rotation of advancement rollers 74. In this way, printing of characters, graphics, etc, can be carried out as patterns of dots.

The thermo-sensitive ink block 76 can have any desired color, by appropriate selection of the pigments and dyes used in its manufacture. Thus, by providing a plurality of thermo-sensitive ink receptacles 70, containing a plurality of thermo-sensitive ink blocks of different colors, color printing can be performed.

It should be noted that other means can be employed to produce heat for melting thermo-sensitive ink block 76, other than thermo-sensitive ink melting heater 71. For example a current of hot air, heat reflectors or other heating means may be employed. It is also possible to carry out printing by moving the thermo-sensitive ink receptacle 70, rather than by moving the recording medium 12.

Figure 11:
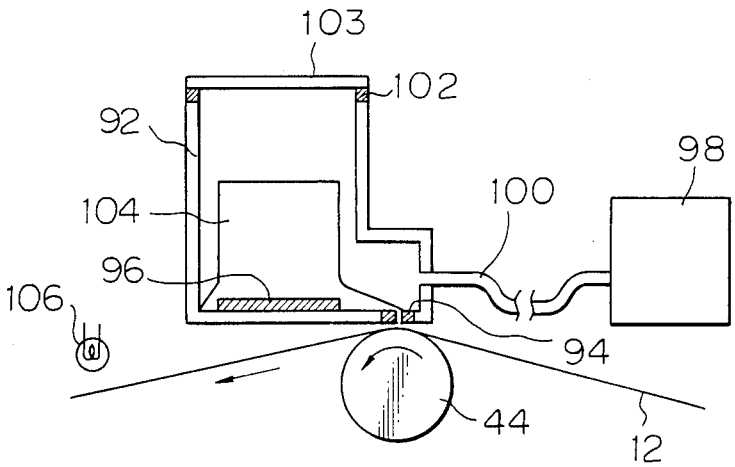
FIG. 11 to FIG. 13 illustrate another embodiment of the present invention, in which heating means for guiding and transporting the thermo-sensitive ink to a plurality of selectively activatable heater elements by capillary action are disposed within a hermetically sealed chamber at high pressure.

FIG. 11 is a side view taken in partial cross-section showing the general configuration of another embodiment of the present invention. A hermetically sealed chamber 92 contains a plurality of heating elements 94, and also heaters 96 for melting and thereby liquifiying a thermo-sensitive ink 104 to thereby transport the ink to heating elements 94, with a flexible pipe 100 being coupled from the lower right-hand side of the hermetically sealed chamber 92 to an air pump 98 which generates air under pressure. At the upper part of hermetically sealed chamber 92, a cover 103 is provided. This is removably attached, with hermetic sealing being provided by packing 102, and thermo-sensitive ink 104 is inserted into hermetically sealed chamber 92 by removing this cover 103. The recording paper 12 is disposed adjacent to the underside of heating elements 94, with a platen 44 being disposed beneath recording paper 12. An infra-red lamp 106 is disposed to irradiate the recording paper 12 after printing thereon has been performed.

Figure 12:
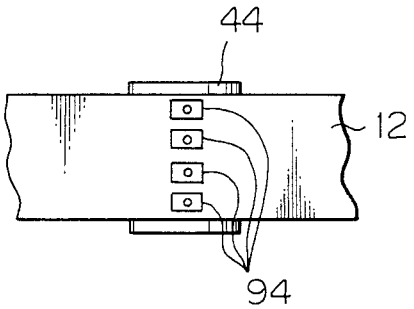
Figure 13:
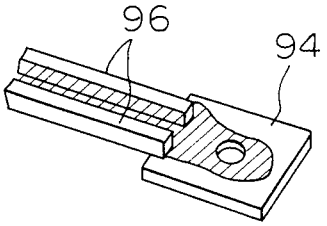

FIG. 12 is a plan view which shows the relationships between the heating elements, the recording paper and the platen. FIG. 13 is an oblique view illustrating the relationship between a heater which transports the thermo-sensitive ink by capillary action and the corresponding heating element. As shown, the heater comprises two elongated heater members 96 whose temperature is increased by passing an electric current therethrough, spaced apart by a narrow gap, with melted ink flowing along this gap to reach the heating element 94 by capillary action. The hatched-line portions indicate the melted thermo-sensitive ink.

Figure 14:
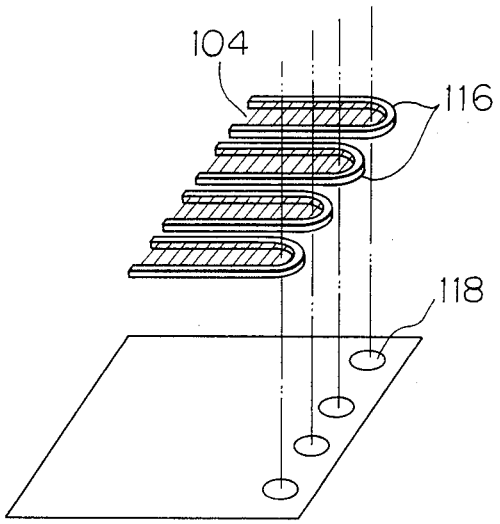
FIG. 14 illustrates an alternative configuration for heater elements and heaters used in the embodiments of FIG. 11 and FIG. 13.

FIG. 14 shows an oblique view of another configuration for the heating elements and heaters of FIG. 13. In this case, each heating element and the corresponding heater which transports the thermo-sensitive ink by capillary action to that heating element are formed integrally as a single component, with the combined heating element being designated by numeral 116.

Figure 15:
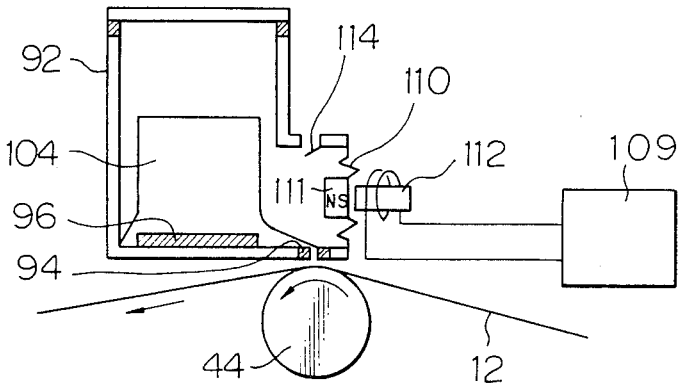
FIG. 15 illustrates another embodiment, similar to that of FIG. 11, but in which the pressure within a pressurized chamber containing thermo-sensitive ink is periodically varied.

Thermo-sensitive ink ejection apertures 118 are formed in the lower face of hermetically sealed chamber 92, with these apertures being shown in FIG. 15 displaced from the heating elements 116 for ease of understanding. The hatched portions in the drawing denote the melted thermo-sensitive ink.

The operation will now be described, referring first to FIG. 11. To insert thermo-sensitive ink 104, the cover 103 is opened and the ink placed inside hermetically sealed chamber 92. Cover 103 is then closed, with a hermetically sealed condition then being established by packing 102. The thermo-sensitive ink 104 is a colored solidified ink, which can comprise a wax containing dyes, pigments, etc, which is solid at normal temperatures and liquifies when the temperature is increased. When heaters 96 are heated by passing an electric current through electrodes thereof (not shown in the drawings), then the lower part of the block of thermo-sensitive ink 104 becomes melted and flows towards heating elements 94. When the ink reaches the through-holes formed in heating elements 94, then the melted ink becomes cooled by radiation and thereby blocks these through-holes. Pulses of current are then selectively passed through electrodes (not shown in the drawings) of heating elements 94 in accordance with image signals. When such a current pulse is applied to a heating element 94, then the thermo-sensitive ink on that heating element becomes melted. Each of heating elements 94 is disposed on the lower face of hermetically sealed chamber 92. As a result of air pressure applied through flexible pipe 100 from air pump 98, the melted thermo-sensitive ink on a heating element 94 which has been supplied with a current pulse is forcibly ejected out of the ink ejection aperture 118 of that heating element, onto the recording paper 12, and coools to be thereby recorded on the recording paper 12 as a hardened dot.

It should be noted that it is possible to either pass current continuously through heaters 96, while recording is in progress, or to supply a pulses of current to heaters 96 in synchronism with pulses of current supplied to heating elements 94.

After the melted thermo-sensitive ink has been ejected from heating element 94, and the flow of current in that element has terminated, the heating element will still remain at a high temperature for a short time. As a result, some thermo-sensitive ink will flow into the through-hole of that heating element 94, and will cool by radiation and harden, thereby blocking the through-hole.

By repetition of the operations described above, characters, graphics etc can be printed in the form of dot patterns.

Each of heaters 96 can comprise a pair of heater members separated by a narrow gap, as in the example of FIG. 13. This ensures a smooth flow of thermo-sensitive ink to the heating elements by capillary action. FIG. 15 shows another embodiment of the present invention, which is basically similar to that of FIG. 11, but in which the air pressure within the chamber 92 is made to vary periodically, i.e. to periodically rise above atmospheric pressure. By synchronizing the timing of such pressure increases with the timing of electrical signals applied to the heater elements 94, greater efficiency and speed of operation is attainable. In FIG. 15, a source 109 of periodic drive signals (e.g. a pulse generator circuit) applies drive signals to the coil of an electro-magnetic solenoid 112, which is disposed adjacent to a permanent magnet fixedly mounted on a flexible diaphragm 110. The varying magnetic field produced by the solenoid acts on the permanent magnet 111 to periodically drive the diaphragm 110 in and out, to thereby periodically vary the pressure within chamber 92.

In the embodiment of FIG. 15, as in that of FIG. 11, the heaters 96 and heating elements 94 shown in FIG. 13 can be replaced by the combination heating element-/heaters 116 which are shown in FIG. 15, each being formed as a single integral component.

Reheating of recording paper 12 after printing of dots thereon, by the infrared lamp 106 which is shown in FIG. 11, serves to improve and stabilize the printed output. Such reheating can be performed by means other than radiation, such as convection heating or conduction heating. In addition, pressure stabilization of the printed output can also be envisaged.

Figure 16:
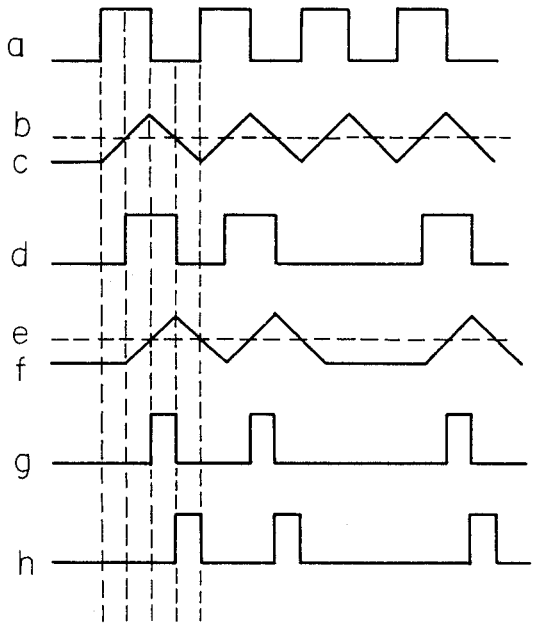
FIG. 16 is a waveform diagram illustrating the relationships between thermo-sensitive ink temperature, air pressure within the hermetically sealed chamber, and printing operation, for the embodiment of FIG. 14.

FIG. 16 shows waveforms to illustrate the operation of the embodiment of FIG. 15, with the waveform of the voltage applied from pulse generator 109 to electromagnetic solenoid 112 being designated as waveform a, and the waveform of variations in air pressure within hermetically sealed chamber 1, designated as waveform c. The broken line b denotes the threshold pressure, above which the thermo-sensitive ink can be ejected. When voltage pulses having waveform d are applied to heater element 94, then the temperature of that heater element and of the thermo-sensitive ink which is in contact with it will vary in accordance with waveform f. The broken line e indicates the threshold temperature, above which thermo-sensitive ink 104 will melt. The conditions for the thermo-sensitive ink to be ejected by a heater element are that the air pressure should be higher than the broken line b, and that the temperature of the thermo-sensitive ink should be higher than the broken line e, i.e. the conditions which are met at times denoted by waveform g. The conditions for supplying thermo-sensitive ink to heater element 94 are that the air pressure must be lower than the broken line b, and that the temperature of the thermo-sensitive ink must be higher than that of broken line e, i.e. the conditions which occur at timings indicated by waveform h. It can thus be understood that the thermo-sensitive ink is ejected in accordance with waveform g, and is supplied to the heater elements in accordance with waveform h.

Thus, by selectively supplying voltage pulses in accordance with image signals, to a plurality of heater elements 94, characters, graphics, etc can be printed in the form of dot patterns.

Figure 17:
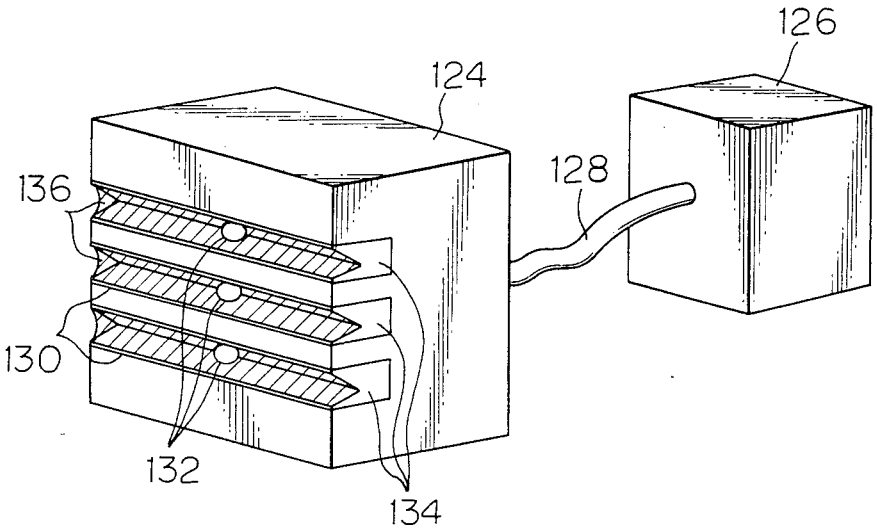
FIG. 17 and FIG. 18 illustrate a printing head for another embodiment of the present invention, in which heater means for transporting and guiding thermo-sensitive ink to ink ejection apertures are formed on an exterior face of a pressurized chamber having the ink ejection apertures formed therein.
Figure 18:
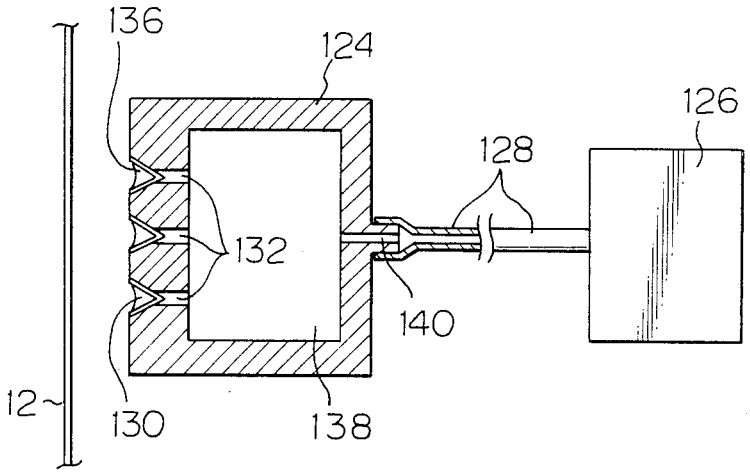

FIGS. 17 and 18 show another embodiment of a printer head for an ink transfer printer according to the present invention. FIG. 17 shows the overall configuration, in oblique view, and FIG. 18 shows the main components in cross-sectional side view. Numeral 124 denotes the printer head itself, which is formed of an electrically insulating material having a high resistance to heat, such as ceramic. It contains an air-tight pressure chamber 138, which is coupled to an air compressor 126 by a tube 128. A narrow-bore throttle section is provided in the path between the air compressor 126 and the pressure chamber 138. A plurality of V-shaped grooves are formed in the front face of printer head 124, i.e. the face which is situated opposite and adjacent to the recording medium 12. A heater element 130 is provided in the side faces of each of the V-shaped grooves. It should be noted that the grooves need not necessarily be V-shaped, but could be of any other suitable shape, e.g. U-shaped. The heater elements 130 are resistive elements, which can be formed of evaporatively deposited metal, non-electrolytic metal plating, thick-film resistor printing, etc. An air hole 132 is provided communicating between the central portion of each of heater elements 130 and the pressure chamber 138. Each of heater elements 130 is provided with a pair of electrodes 134, formed on the side faces of printer head 124. These electrodes 134 are provided symmetrically on each side of printer head 124 for each heater element, with one set of these electrodes 134 being hidden in the oblique view of FIG. 17.

A thermo-sensitive ink 136, which is hard at normal temperatures as in the previous embodiments, is positioned in contact with each of heater elements 130. Recording medium 12 (comprising for example recording paper) is disposed opposite and adjacent to the front face of printer head 124. The thermo-sensitive ink is temporarily heated and thereby liquified by means not shown in the drawings, and thereby passes along the V-shaped grooves and hence over heater elements 130 to cover the air holes 132. As the thermo-sensitive ink passes along the V-shaped grooves, then assuming that the heater elements are not being activated, the ink cools and solidifies to thereby plug the air holes 132. It can thus be understood that in this embodiment the heater elements themselves are shaped such as to serve as means for transporting the thermo-sensitive ink to the air holes 134, with these ink transportation means being provided on the exterior of printer head 124. However it should be noted that it is also possible to provide other means for transporting the thermo-sensitive ink to the air holes 132, such as pipes, etc.

Compressed air is supplied from air compressor 126 through tube 128, and hence is transferred to pressure chamber 138, so that the air pressure within pressure chamber 138 becomes higher than the atmospheric pressure. This pressure is applied through air holes 132 to thermo-sensitive ink 136. However since the thermo-sensitive ink is solid at normal temperatures, the air holes are plugged and no transfer of ink to the recording paper 12 takes placed. If now a pulse of current is applied from a pulse generator (not shown in the drawings) to the electrodes 134 of one of heater elements 130, then that heater element immediately rises to a high temperature, and the thermo-sensitive ink in contact with that heater element 130 becomes heated and hence melted. Due to the internal pressure in pressure chamber 132, the melted thermo-sensitive ink is ejected by air passed out of air hole 132, towards the recording paper 12, and forms a dot thereon. Since an amount of air is ejected from pressure chamber 138 that is equal to the amount of thermo-sensitive ink 136 that was ejected from air hole 132, and since the supply of air from air compressor 126 to pressure chamber 138 is limited by the flow resistance exerted by throttle section 140, the pressure in pressure chamber 138 momentarily drops in response to the ejection of thermo-sensitive ink. At the moment of ink ejection, a hole is formed in the melted thermo-sensitive ink which is of identical cross-section to the air hole 132. However, as a result of the drop in pressure in pressure chamber 138 immediately after ink ejection, and the tendency of the surface tension of the thermo-sensitive ink to act to close the hole thus formed in it, air hole 132 is very rapidly plugged once more after ink has been ejected. The thermo-sensitive ink from which ejection has taken place then rapidly cools (sinc the current pulse has terminated) and hardens, to thereby fully obstruct air hole 132. Thereafter, the air pressure within pressure chamber 138 again rises to its previous level.

As in the previous embodiments, characters, graphics, etc can be formed as patterns of dots, by such a printer head, by selectively driving a plurality of heater elements 130, in conjunction with advancement of recording paper 12.

With such an ink-ejection embodiment of the present invention, the recording paper does not directly touch the printer head, so that there is a low amount of wear of the head. Ink jet methods of non-contact dot pattern printing are known in the prior art. However with such prior art methods, the ink is liquid at normal temperatures, so that the ink ejection apertures readily become obstructed by solidified matter formed by evaporation of the ink. With the present invention, the ink is solid at normal temperatures, so that such problems do not arise and the ink can be stored for long periods without danger of evaporation.

It can be understood from the above description of the preferred embodiments that the present invention enables an ink transfer thermal printer to be provided which can be of very simple mechanical configuration, and so can be compact and lightweight, can be manufactured at low cost, and can be highly reliable. Since all of the thermo-sensitive ink is used up during the printing operations, a contact type of printer according to the present invention does not produce waste materials such as used ink ribbons or ink films, so that maintenance is simplified and operating costs are lowered. A non-contact (i.e. ink jet) printer according to the present invention can provide more reliable operation than is possible with prior art ink jet printers, since the problems which arise due to evaporation of the ink with such prior art machines do not occur with the present invention.

It should be noted that various changes and modifications to the embodiments described above may be envisaged, which fall within the scope claimed for the present invention as set out in the appended claims. The above specification should therefore be interpreted in a descriptive and not in a limiting sense.

What is claimed is:

1. An ink transfer printer, comprising:

thermo-sensitive ink which is solid at normal room temperature, in the form of at least one member having a coherent mass of predetermined shape;

recording paper and means for transporting said recording paper past said at least one ink member in close proximity thereto;

printing means operable to melt a portion of said one ink member at a position in close proximity to said recording paper, such as to transfer at least a part of said melted ink portion onto said recording paper to form a printed dot thereon, said transportation means acting to move said recording paper relative to said printing means such that desired patterns of said thermo-sensitive ink dots are formed on said recording paper.

2. An ink transfer printer according to claim 1, in which said thermo-sensitive ink is formed into a plurality of elongated members and in which said printing means further comprise means for holding one end of each of said thermo-sensitive ink members in contact with said recording paper and heating means for heating selected portions of said recording paper during predetermined time intervals to thereby transfer heat from said recording paper to melt portions of selected ones of said thermo-sensitive ink members and form said thermo-sensitive ink dots on said recording paper.

3. An ink transfer printer according to claim 2, in which the operating conditions of said printer are adjusted such that the size and shape of said printed dots are substantially identical to the size and shape in cross-section of each of said elongated thermo-sensitive ink members.

4. An ink transfer printer according to claim 2, in which said elongated thermo-sensitive ink members are in the form of narrow elongated rods.

5. An ink transfer printer according to claim 4, in which said means for holding one end of each of said thermo-sensitive ink rods in contact with said recording paper comprise a weight coupled to each of said thermo-sensitive ink rods.

6. An ink transfer printer according to claim 4, in which said means for holding one end of each of said thermo-sensitive ink rods in contact with said recording paper comprise a spring urging each of said thermo-sensitive ink rods into contact with said recording paper.

7. An ink transfer printer according to claim 2, in which said elongated thermo-sensitive ink members are each in the shape of a wire which is wound in a coil.

8. An ink transfer printer according to claim 7, in which said means for holding said thermo-sensitive ink members in contact with said recording paper comprise means for urging each of said coils of thermo-sensitive ink wire towards rotation in a direction to force one end thereof into contact with said recording paper.

9. An ink transfer printer according to claim 2, in which said heating means comprise a plurality of electrical heaters disposed on contact with said recording paper, each of said electrical heater elements being positioned substantially opposing and on the opposite side of said recording paper to a corresponding one of said elongated thermo-sensitive ink members.

10. An ink transfer printer according to claim 2, in which said heater means comprise a plurality of electrical heaters each disposed in contact with said recording paper at a position immediately adjacent to a corresponding one of said elongated thermo-sensitive ink members and advanced from said corresponding elongated thermo-sensitive ink member with respect to the direction of advancement of said recording paper.

11. An ink transfer printer according to claim 9 or 10, and further comprising preheating means for directing a current of hot air onto said recording paper at a position on said recording paper which is in advance of said electrical heater elements with respect to the direction of advancement of said recording paper.

12. An ink transfer printer according to claim 9 or 10, and further comprising cooling means for directing a current of cool air onto said recording paper at a position on said recording paper which is behind said electrical heater elements, with respect to the direction of advancement of said recording paper.

13. An ink transfer printer according to claim 2, in which said heater means comprise electrically activated means for selectively directing jets of hot air onto said recording paper at positions which are immediately adacent to the areas of contact of said elongated thermo-sensitive ink members and are advanced from said areas of contact with respect to the direction of advancement of said recording paper.

14. An ink transfer printer according to claim 1, in which said printing means comprise a plurality of electrical heater elements, each disposed about an aperture and having a lower face in contact with said recording paper, a thermo-sensitive ink melting heater for melting said thermo-sensitive ink, disposed such that said melted thermo-sensitive ink flows towards upper faces of said electrical heater elements, and cooling means disposed between said thermo-sensitive ink melting heater and said electrical heater elements for reducing the degree of fluidity of said melted thermo-sensitive ink, said electrical heater elements being selectively activated to heat and so increase the degree of fluidity of said melted thermo-sensitive ink to an extent enabling said thermo-sensitive ink to flow through the apertures corresponding to said activated electrical heater elements onto said recording paper, with said flow continuing only for the duration of said activation.

15. An ink transfer printer according to claim 1, in which said printing means comprise:

a sealed chamber having one face thereof disposed adjacent to and spaced apart from said recording paper and having a plurality of narrow-bore ink ejection apertures formed in said adjacent face which communicate with the interior of said sealed chamber;

pressurizing means for increasing the air pressure within said sealed chamber to a level above atmospheric pressure;

a plurality of electrically activatable heater elements each having at least a portion thereof formed about a corresponding one of said ink ejection apertures;

ink heating and transporting means in contact with said solidified thermo-sensitive ink, for melting said thermo-sensitive ink and transporting the melted thermo-sensitive ink onto said heater elements such that the degree of fluidity of said thermo-sensitive ink upon reaching said heater elements is sufficiently low to prevent ejection of air from said ink ejection apertures;

said heater elements being selectively activated to melt said thermo-sensitive ink adjacent thereto, whereby said melted thermo-sensitive ink is forcibly ejected towards said recording paper by the action of air from within said sealed chamber escaping to the atmosphere through the ink ejection apertures corresponding to said activated heater elements, said ejected thermo-sensitive ink being deposited upon said recording paper to form printed dots thereon.

16. An ink transfer printer according to claim 15, in which said pressurizing means act to increase the air pressure within said sealed chamber above atmospheric pressure in a periodically repetitive manner.

17. An ink transfer printer according to claim 16, in which said periodic increases of air pressure within said sealed chamber are synchronized with activations of said heater elements.

18. An ink transfer printer according to claim 15, in which said thermo-sensitive ink heating and transporting means are disposed internally within said sealed chamber.

19. An ink transfer printer according to claim 15, in which said thermo-sensitive ink heating and transporting means are disposed external to said sealed chamber.

20. An ink transfer printer according to claim 19, in which said thermo-sensitive ink heating and transporting means comprise a plurality of narrow channels formed upon said face of the sealed chamber which is adjacent to said recording paper, each of said narrow channels having one of said ink ejection apertures formed therein and being provided with heater means formed on a surface thereof.

* * * * *